US011008811B2

(12) United States Patent
Wijning

(10) Patent No.: US 11,008,811 B2
(45) Date of Patent: May 18, 2021

(54) SYSTEM AND METHOD FOR CASING DRILLING WITH A SUBSEA CASING DRIVE

(71) Applicant: ITREC B.V., Schiedam (NL)

(72) Inventor: Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/633,973

(22) PCT Filed: Jul. 24, 2018

(86) PCT No.: PCT/NL2018/050516
§ 371 (c)(1),
(2) Date: Jan. 24, 2020

(87) PCT Pub. No.: WO2019/022601
PCT Pub. Date: Jan. 31, 2019

(65) Prior Publication Data

US 2020/0157888 A1 May 21, 2020

(30) Foreign Application Priority Data

Jul. 26, 2017 (NL) ..... 2019351

(51) Int. Cl.
*E21B 7/20* (2006.01)
*E21B 7/124* (2006.01)
(Continued)

(52) U.S. Cl.
CPC ..... *E21B 7/208* (2013.01); *E21B 7/124* (2013.01); *E21B 33/0355* (2013.01); *E21B 21/001* (2013.01)

(58) Field of Classification Search
CPC .... E21B 21/001; E21B 33/0355; E21B 7/124; E21B 7/208
See application file for complete search history.

(56) References Cited

U.S. PATENT DOCUMENTS 2,512,783 A 6/1950 Tucker
3,435,906 A 4/1969 Nicolson
(Continued)

FOREIGN PATENT DOCUMENTS

GB 2502626 A 12/2013
WO WO 00/04269 A2 1/2000
(Continued)

OTHER PUBLICATIONS

International Search Report, issued in PCT/NL2018/050516, dated Oct. 22, 2018.
(Continued)

*Primary Examiner* — James G Sayre
(74) *Attorney, Agent, or Firm* — Birch, Stewart, Kolasch & Birch, LLP

(57) ABSTRACT

A system and method for casing drilling with a subsea casing drive adapted to engage at the outer circumference of the casing string, to impart a linear force and/or torque to the casing string, and such a subsea casing drive per se are disclosed. During drilling, the subsea casing drive is provided in a subsea unit further comprising a blowout preventer, a pressure control device and a mud pump with an outlet to a mud hose connectable to a surface vessel. The wellbore is drilled by driving the bottom hold assembly, BHA, and the casing string into the wellbore by the subsea casing drive, while discharging mud and cuttings via the mud hose and supplying mud to the BHA from the mud circulation system on the vessel via the landing string and casing string.

3 Claims, 1 Drawing Sheet

(51) Int. Cl.
*E21B 33/035* (2006.01)
*E21B 21/00* (2006.01)

(56) References Cited

U.S. PATENT DOCUMENTS

| | | | | |
|---|---|---|---|---|
| 3,891,037 | A | 6/1975 | Well et al. | |
| 6,102,673 | A | 8/2000 | Mott et al. | |
| 9,963,947 | B2 * | 5/2018 | Kjosnes | E21B 21/001 |
| 2010/0126776 | A1 * | 5/2010 | Trevino | E21B 17/07 175/61 |
| 2017/0335649 | A1 * | 11/2017 | Hansen | E21B 33/035 |

FOREIGN PATENT DOCUMENTS

| | | | | |
|---|---|---|---|---|
| WO | WO-2009157762 | A1 * | 12/2009 | E21B 7/122 |
| WO | WO 2012/015315 | A1 | 2/2012 | |
| WO | WO 2016/081215 | A1 | 5/2016 | |
| WO | WO 2016/118008 | A1 | 7/2016 | |

OTHER PUBLICATIONS

Sangesland et al., "Riserless Casing While Drilling Using a Dual Gradient Mud System", Proceedings of the Eleventh (2001) International Offshore and Polar Engineering Conference, Stavanger, Norway, Jun. 17-22, 2001, pp. 227-233.
Written Opinion of the International Searching Authority, issued in PCT/NL2018/050516, dated Oct. 22, 2018.

* cited by examiner

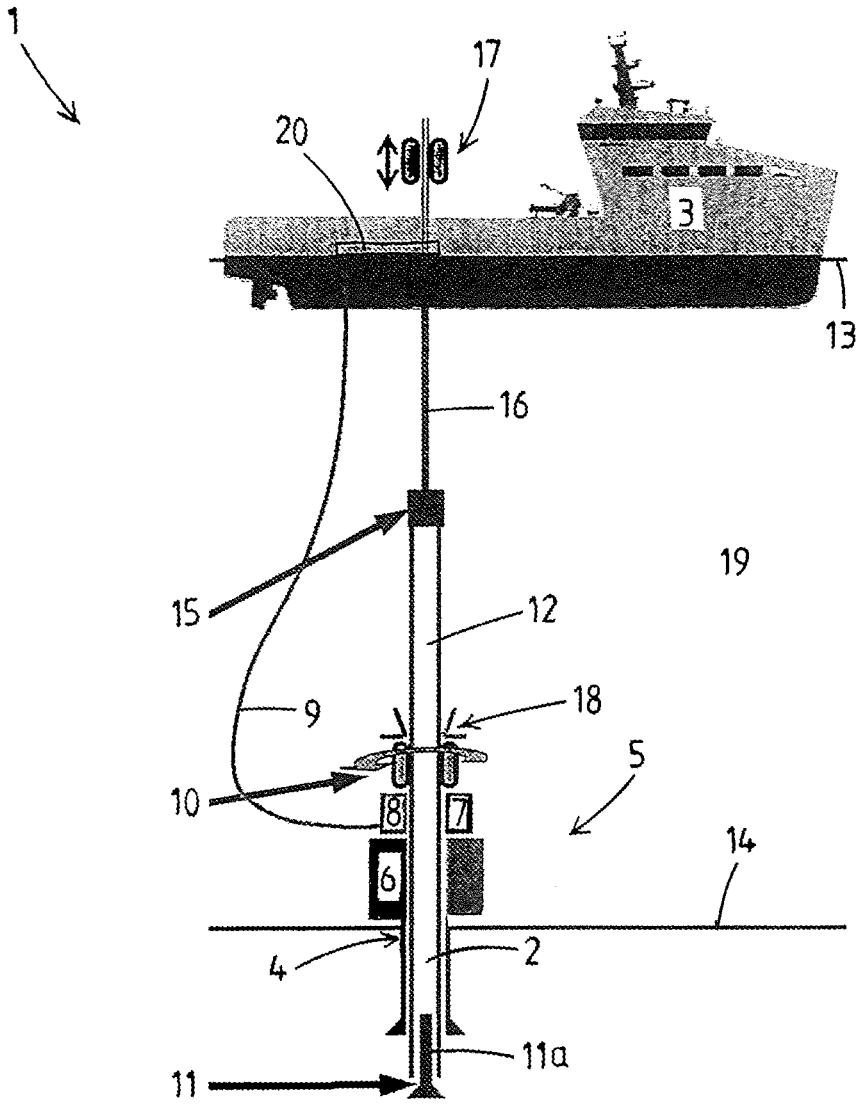
1
17
20
3
13
16
19
15
12
9
18
5
10
8
7
6
14
4
2
11a
11

SYSTEM AND METHOD FOR CASING DRILLING WITH A SUBSEA CASING DRIVE

Natural resources such as oil and gas are discovered through exploration activities. Holes are drilled in the ground to evaluate the sub-surface geology in a particular area. The drill holes indicate whether or not oil and gas and other potentially economic resources are present, and the drill hole data assessment of the quantity and quality of those resources.

Normally holes are drilled which are designed and drilled for oil and gas production but are used for exploration. Lately a trend is observed where holes are designed and drilled for exploration only. When oil and gas are found, a bespoke production hole will be drilled for producing the hydrocarbons.

The holes designed for oil and gas exploration can be more narrow as holes designed for production as the function of the hole is different, in particular no hydrocarbons have to flow efficiently through the exploration hole. Such narrow diameter holes are frequently called slim holes.

The exploration holes have to stay open for a relative short period of time, just long enough to explore the formation, e.g. 2-3 weeks. This implies that less casing might be needed. By drilling slim holes and applying less casing, costs are reduced significantly. For example because less mud is required during drilling, less formation is to be drilled, less casing is needed and smaller equipment can be used. Not only the costs are reduced, but generally also drilling can be faster.

Prior to drilling, a wellhead is placed above the formation to be drilled. On top thereof a blow out preventer (BOP) is provided. Drilling takes place through the BOP and the wellhead. The 30 wellhead for slim hole drilling can be smaller than a conventional size of 18¾ inch (47.6 cm), but instead 11 inch (30 cm).

Casing is a relatively large diameter tubular member usually used to line or "case" a borehole after drilling but before production. Casing is provided to aid the drilling process, e.g. by preventing contamination of fresh water well zones, preventing unstable upper formations from caving in, isolating different zones, preventing fluid loss into or contamination of production zones, etc. etc.

It is known in the art to, in occasions, drill with casing, instead of using a drill string. To this end, a bottom hole assembly (BHA) is provided at the lower end of the casing string. A so-called drill bit of the BHA is driven by a mud motor of the BHA to perform drilling.

The aim of a first aspect the present invention is to provide an improved method and system of casing drilling in deep water.

This is achieved by a method for casing drilling a deepwater subsea slim hole wellbore wherein use is made of a surface vessel and of a subsea unit, the subsea unit comprising:

- a subsea blowout preventer (BOP),
- a subsea pressure control device (PCD),
- a subsea mud pump with an outlet to a mud hose connectable to the surface vessel,
- a subsea casing drive, adapted to engage at the outer circumference of the casing string, to impart a linear force and/or torque to the casing string;

the method comprising the steps of:

- installing the subsea unit onto a wellhead,
- providing a bottom hole assembly (BHA) with a drill bit at a lower end of a casing joint;

- assembling multiple casing joints to form a casing string while suspending the casing string from the vessel;
- connecting a swivel to a top end of the casing string;
- connecting a landing string to the swivel, the swivel allowing rotation of the casing string with respect to the landing string;
- lowering the interconnected BHA and casing string into the subsea unit;
- drilling the wellbore wherein the drill bit of the BHA is rotated and wherein the casing string is driven by means of the subsea casing drive, while discharging mud and cuttings via the mud hose and supplying mud to the BHA from a mud circulation system on the vessel via the landing string and casing string.

This is also achieved by a casing drilling system for a deepwater subsea slim hole wellbore, comprising in combination:

- a surface vessel with a casing string assembly installation and a hoist system suitable to lower and suspend the weight of the following interconnected components: a bottom hole assembly (BHA), the casing string, a swivel and a landing string; the surface vessel further comprising a mud circulation system;
- a subsea unit to be provided on top of a wellhead of the wellbore, the subsea unit comprising
  - a subsea blowout preventer (BOP),
  - a subsea pressure control device (PCD),
  - a subsea mud pump with an outlet to a mud hose connectable to the surface vessel,
  - a subsea casing drive, adapted to engage at the outer circumference of the casing string, to impart a linear force and/or torque to the casing string.

The first aspect of the invention also relates to the use of such a casing drilling system for casing drilling a deepwater subsea slim hole wellbore, the wellbore comprising a wellhead on top of which the subsea unit is installed.

Furthermore, the first aspect of the invention relates to a subsea unit per se, to be used in combination with a surface vessel for casing drilling a deepwater subsea slim hole wellbore, comprising a subsea blowout preventer (BOP); a subsea pressure control device (PCD); a subsea mud pump with an outlet to a mud hose connectable to the surface vessel; a subsea casing drive, adapted to engage at the outer circumference of the casing string, to impart a linear force and/or torque to the casing string.

Furthermore, the first aspect of the invention relates to a subsea casing drive adapted to engage at the outer circumference of the casing string, to impart a linear force and/or torque to the casing string, to be used in combination with a surface vessel for casing drilling a deepwater subsea slim hole wellbore and in combination with a subsea unit as described above.

The method and system of the invention are in particular advantageous in drilling in deep water, e.g. up to 12000 feet (3658 metres). It is possible to prepare and suspend an elongated casing string, e.g. up to 8000 feet (2438 metres) in the water, and lower the casing string as a whole by driving the subsea casing drive. An advantage of lowering the casing string as a whole is the relatively high rotational stiffness of the casing string.

According to the first aspect of the invention, the casing string is suspended via a swivel and a landing string, e.g. coiled tubing, from the surface vessel. A bottom hole assembly is connected to the lower end of the casing string.

The subsea casing drive is adapted to engage at the outer circumference of the casing string, to impart a linear force and/or torque to the casing string. The swivel allows rotation of the casing string with respect to the landing string, and thus comprises a revolving component. The landing string is possibly embodied as coiled tubing, or alternatively as jointed pipe, e.g. drill pipe. An advantage of providing the subsea casing drive in the subsea unit is that there is no need for a top drive on the vessel. The surface vessel can be a relatively small vessel.

The casing drive may assist in drilling the wellbore. E.g. by changing the linear force on the casing string, the weight on bit of the BHA can be adjusted. Torque imparted on the casing string may assist in drilling. In the embodiment of the invention, the bit of the BHA is driven by either rotating the casing and/or by a mud motor of the BHA to perform drilling.

In embodiments, it is also advantageously possible that the torque generated by the subsea casing drive is used for steering, as disclosed in WO 2016/118008, and/or relieving friction between casing and borehole, thereby driving the casing string into the borehole. This is in particular advantageous for slim hole casing, as the wellbore diameter is relatively small compared to the diameter of a production well.

As the surface vessel is subject to heave, a provision for heave compensation is advantageously provided. With a landing string embodied as coiled tubing, the vessel is advantageously provided with a heave compensated coiled tubing injector.

Yet another advantage of casing drilling is that a riser for the fluid flow can be dispensed with, also referred to as 'riserless drilling'. By mounting a rotating control device (RCD) or a pressure control device (PCD) and pumping the mud out of the SSBOP and into a separate mud return hose, a riser guiding the mud back to the vessel is not required. The surface vessel can be a relatively small vessel, as there is not riser and associated equipment required.

The invention is further explained in relation to the drawings, in which:

FIG. 1 depicts a schematic side view of the casing drilling system of the first aspect of the invention.

In FIG. 1 a casing drilling system 1 is shown, according to a first aspect of the invention, for a deepwater subsea slim hole wellbore 2. The wellbore 2 comprises a surface termination, called a wellhead 4 at the bottom of the sea, indicated with reference numeral 14. This is also referred to as the mudline.

The casing drilling system 1 comprises a surface vessel 3, provided on the water surface. The waterline is indicated with reference numeral 13. The vessel is a relatively small vessel, as it does not have any riser-related equipment. The surface vessel does comprise a casing string assembly installation, not shown, to assemble casing joints together to form a casing string 12. Furthermore, according to the first aspect of the invention, a bottom hole assembly (BHA) 11 is to be connected to a lower end of the casing string, and a swivel 15 to an upper end of the casing string. A landing string 16 is connected to the swivel, and the vessel 3 comprises a hoist system 17 suitable to lower and suspend the weight of these interconnected BHA 11, casing string 12, swivel 15 and landing string 16.

In the shown embodiment, the landing string 16 is embodied as coiled tubing. The hoist system 16 of the vessel is embodied as a heave compensated coiled tubing injector 17, to provide heave compensation to the interconnected BHA, casing string, swivel and landing string during drilling. Alternative hoist systems are also conceivable. It is also conceivable that the heave compensation of the interconnected elements is provided differently, e.g. via the swivel or the landing string.

Furthermore, the casing drilling system 1 comprises a subsea unit 5, installed on top of the wellhead 4. The subsea unit comprises a blowout preventer (BOP) 6, provided directly above the wellhead 4. Thereabove a pressure control device (PCD) 7 is provided. It is conceivable that this is a rotating control device (RCD). In the casing drilling system of the invention, a mud pump 8 is provided in the vicinity of the PCD, to provide a discharge of mud and drilling fluids and cuttings from the subsea unit 5 directly to the surface vessel 3, via mud hose 9.

In the casing drilling method according to the first aspect of the invention, the interconnected BHA 11, casing string 12, swivel 15 and landing string 16 are lowered into the water 19. Advantageously, in the shown embodiment, the subsea unit 5 is provided with a guide funnel 18, to lower the interconnected BHA and casing string into the subsea unit 5.

Then, the wellbore 2 is being drilled by driving the BHA and the casing string into the wellbore by the subsea casing drive 10, engaging at the outer circumference, i.e. the exterior of the casing string 12. Mud is supplied to the BHA from a mud circulation system 20 on the vessel via the landing string 16 (through the swivel 15) and casing string 12. The mud is a drilling fluid used to aid the drilling process. The BHA is optionally provided with a mud motor 11*a*, in which case the mud is used to drive the mud motor. Another function of the mud is to provide hydrostatic pressure.

The invention claimed is:

1. A method for casing drilling a deepwater subsea slim hole wellbore wherein use is made of a surface vessel and of a subsea unit, the subsea unit comprising:

a subsea blowout preventer;

a subsea pressure control device;

a subsea mud pump with an outlet to a mud hose connectable to the surface vessel; and a subsea casing drive, adapted to engage at the outer circumference of the casing string, to impart a linear force and/or torque to the casing string, the method comprising the steps of:

installing the subsea unit onto a wellhead;

providing a bottom hole assembly, BHA, with a drill bit at a lower end of a casing joint;

assembling multiple casing joints to form a casing string while suspending the casing string from the vessel;

connecting a swivel to a top end of the casing string;

connecting a landing string to the swivel, the swivel allowing rotation of the casing string with respect to the landing string;

lowering the interconnected BHA and casing string into the subsea unit; and drilling the wellbore, wherein the drill bit of the BHA is rotated and wherein the casing string is driven by the subsea casing drive, while discharging mud and cuttings via the mud hose and supplying mud to the BHA from a mud circulation system on the vessel via the landing string and casing string.

2. The method according to claim 1, wherein the BHA comprises a mud motor, and wherein the step of driving the BHA is performed by supplying mud to the mud motor of the BHA.

3. The method according to claim 1, wherein the landing string is embodied as coiled tubing, and wherein the vessel is provided with a heave compensated coiled tubing injector to provide heave compensation during drilling.

* * * * *